United States Patent [19]

Gupta

[11] 4,044,077

[45] Aug. 23, 1977

[54] VARIABLE VENTURI NOZZLE-MATRIX CARBURETOR ADD METHODS FOR INTERMIXING FUEL AND AIR

[75] Inventor: Viney Kumar Gupta, Newport Beach, Calif.

[73] Assignee: Matrix, Inc., Santa Ana, Calif.

[21] Appl. No.: 661,318

[22] Filed: Feb. 25, 1976

[51] Int. Cl.[2] ..... F02M 29/04

[52] U.S. Cl. ..... 261/23 A; 48/180 M; 123/141; 261/62; 261/78 R; 261/DIG. 39; 261/DIG. 48; 261/DIG. 78; 261/142

[58] Field of Search ..... 123/141; 261/DIG. 48, 261/78 R, 62, 23 A, DIG. 39, DIG. 78; 48/180 M, 180 B

[56] References Cited

U.S. PATENT DOCUMENTS

| | | | |
|---|---|---|---|
| 1,103,931 | 7/1914 | Bennett | 123/141 |
| 1,139,747 | 5/1915 | Bayley | 48/180 M |
| 1,335,665 | 3/1920 | Deppe | 123/141 |
| 1,637,697 | 8/1927 | Jacobsen | 48/180 M |
| 1,777,141 | 9/1930 | Howden | 261/78 R |
| 1,790,854 | 2/1931 | Defrance et al. | 123/141 |
| 2,094,959 | 10/1937 | Pulidori | 261/78 R |
| 2,968,147 | 1/1961 | Truly, Jr. et al. | 261/DIG. 48 |
| 3,016,233 | 1/1962 | Olmstead | 261/DIG. 48 |
| 3,874,357 | 4/1975 | Schreiber et al. | 123/141 |
| 3,966,430 | 6/1976 | Stephens | 123/141 |

FOREIGN PATENT DOCUMENTS

| | | | |
|---|---|---|---|
| 880,821 | 7/1953 | Germany | 123/141 |
| 531,647 | 8/1931 | Germany | 261/62 |
| 323,584 | 1/1930 | United Kingdom | 123/141 |

*Primary Examiner*—Tim R. Miles
*Attorney, Agent, or Firm*—Gary Appel; Gene Arant

[57] ABSTRACT

Apparatus for homogeneously intermixing flows of fuel and air to an internal combustion engine comprises a mixing chamber having a venturi portion across which is disposed an arcuate nozzle-matrix of converging nozzle cells which focus subflows toward pre-selected downstream crossflow mixing zones. A mainstream flow of air is introduced into the chamber upstream of the nozzle-matrix and one or more mainstream flows of fuel are introduced into the chamber upstream of the nozzle-matrix and/or into the crossflow mixing zones. The nozzle-matrix is adapted to accept at least portions of the main upstream flows to generate several optimum velocity subflows therefrom to enhance fuel and dispersion, atomization, and vaporization into the air. A transversely movable cylindrical gate, installed through a wall of the chamber, is provided for selectively restricting subflows through at least some of the nozzle cells to thereby vary the effective combined cross-sectional area of the nozzle-matrix and maintain pre-selected velocity subflows through the unrestricted nozzle cells over wide ranges of engine fuel-air mixture demands. The substantially homogeneous fuel-air mixture is discharged from a lower region of the chamber, downstream of the nozzle-matrix, into an engine intake manifold. Several variations are illustrated and described. Corresponding methods of homogeneously intermixing fuel and air are provided.

25 Claims, 21 Drawing Figures

VARIABLE VENTURI NOZZLE-MATRIX CARBURETOR ADD METHODS FOR INTERMIXING FUEL AND AIR

BACKGROUND OF THE INVENTION

1. Field of the Invention

The present invention relates to apparatus and methods for intermixing flows of fuel and air; and, more particularly, it relates to such apparatus adapted for use with internal combustion engine carburetors.

2. Discussion of the Prior Art

Internal combustion engines, for example, those used in automobiles, normally employ some type of carburetor which meters and intermixes flows of fuel and air to the engine. As the mainstream supply air, which is usually regulated by a butterfly valve, flows through a venturi portion of the carburetor, fuel is drawn into the carburetor through one or more fuel jets from a float controlled reservoir. The venturi portion, through which the air and entrained fuel flow at high velocities, is largely responsible for atomization of the fuel into air flow; that is, for breaking up the streams of liquid fuel into very small droplets and for dispersing these droplets throughout the air flow.

For effectively atomizing the fuel and dispersing the fuel droplets in the air flow, it is generally agreed that the flow velocity through the carburetor venturi be nearly sonic, and also that such sonic flow occurs when the vacuum in the engine intake manifold, into which the carburetor discharges, is equal to about 14.3 inches of mercury. This is discussed, for example, in the patent by Eversole et al (U.S. Pat. No. 3,778,038), in which is discussed various well-known problems associated with incomplete atomization of the fuel and inadequate mixing of the fuel droplets into the air flow, both of which are common occurrences unless the chamber venturi vacuum exceeds about 12 inches of mercury.

As an illustration of effects of such known problems, even though a carburetor may provide a fuel to air ratio theoretically calculated to provide substantially complete combustion of the fuel in the engine, a poorly atomized fuel flow and an inadequate mixing of the fuel into the air flow, usually causes a fuel-air mixture flow to some engine cylinders which is too fuel rich to burn—often even including liquid fuel itself—and a flow to other cylinders which is too fuel lean to burn. These conditions are worsened and made more prevalent when, upon acceleration, extra fuel is pumped by an acceleration pump into the carburetor, and also by asymmetrical positioning of the butterfly valve which acts as an obstruction.

Wheter incomplete fuel combustion is caused by a too rich or a too lean mixture, the effect is the same: discharging of unburned hydrocarbons into the atmosphere through the engine exhaust. This wastes increasingly expensive fuel and is wasteful of an important natural resource which is becoming increasingly scarcer.

In addition, and to many even more importantly, the discharged unburned fuel becomes a major source of air pollution, it being commonly acknowledged that substantial amounts of the gasoline used by automobiles are currently discharged as hydrocarbons into the atomosphere because of incomplete combustion in the engine. Although even with complete fuel combustion, pollutants such as carbon monoxide and dioxide are emitted into the air, these are considered generally harmless when compared to other fuel pollutants.

One often suggested way to eliminate at least some of the air pollution due to incomplete fuel combustion has been to mix additional air into the fuel-rich exhaust gases and ignite the mixture in an exhaust "afterburner". There are, however, many practical problems associated with implementing this technique. In addition, afterburning does not directly attack the problem of poor combustion in the engine—that is, the basic problem of poor fuel-air intermixing—and neither utilizes the exhausted fuel to advantage nor prevents its wastage.

Another technique that has been widely used, in an attempt to provide more effective mixing of the fuel into the air by enhancing the vaporization of the fuel, has been to heat the carburetor or portions thereof and/or the intake manifold by engine generated heat recovered from either the engine exhaust or cooling systems. However, even with such heating, thorough fuel and air intermixing is at best rarely achieved, largely because the heated surface area—walls of the carburetor or intake manifold—is not large compared to the volume of the carburetor and manifold intake, and insubstantial heating of the fuel usually occurs. At best, such heating techniques are stopgap attempts to overcome conventional, inefficient carburetor designs.

These inefficiencies largely relate to the fact that commonly used carburetors have fixed cross section venturi portions in which most of the fuel-air mixing occurs. The fixed cross sectional area of the venturi is selected by compromising among various different anticipated engine operating conditions, and attempting to provide substantially sonic venturi flow under the most prevalent, expected operating conditions. As a consequence, the venturi cross sectional area is often too great to provide sonic flow and good fuel-air mixing for many conditions, particularly those conditions, such as acceleration, when large quantities of fuel are introduced into the carburetor without corresponding large quantities of air.

Recognizing the basic problem associated with fixed cross sectional area venturi, various disclosures provide a variable cross sectional area venturi for carburetors; venturi whose cross section may be automatically changed in response to engine demand for fuel and air. By such expensive control means, sonic flow through the venturi should be maintainable over wide engine operating ranges. Examples of such disclosures include that of Eversole et al, mentioned above, and those of Barnes, Jr., Shaw, Mock, Stresen-Reuter, Kimberley, Rhodes et al, Pelizzoni, Kincade, Hartshorn, Harrison and Freismuth, et al (U.S. Pat. Nos. 3,911,063; 2,066,544; 2,118,220; 2,468,416; 2,525,083; 3,464,803; 3,880,962; 3,659,572; 3,778,041; 2,052,225; 3,896,105; and 3,841,612, respectively). Such activity in this field is evidence of the considerable magnitude of the problem and the potential benefits which should be achievable.

Still other disclosures relate to use of generated sound waves, usually ultrasonic, to agitate the fuel-air flows and enhance the breaking up of the fuel into very small droplets and the dispersing of the droplets into the air by application of sound wave energy. Examples of such disclosures include those of Cottell, Thatcher, Fruengel, Grieb and Bartholomew (U.S. Pat. Nos: 2,756,575; 3,907,940 and 3,533,606; 3,908,433; 2,791,944; and 3,834,364, respectively). Again, the activity in this particular area attests to the magnitude of problems with conventional carburetors and the potential benefits to be gained.

The amount of activity in these mentioned fields of endeavor also is indicative, however, that the problems associated with poor carburetor fuel-air mixing have not yet been satisfactorily solved. For instance, many types of variable cross section venturi, while potentially providing sonic flow over wide operating ranges, lack homogenizing means and thus give rise to inadequate intermixing. Also, at least some of the fuel-air intermixing and much of the fuel vaporization is associated with fuel flow along surfaces of the venturi, and even variable cross section venturi having appropriate characteristics to assure velocity under most engine operating conditions still have such relatively low surface to volumetric flow rates that mixing of fuel vapor is not optimized, particularly for fuel rich flows. And, while addition of sonic wave energy may assist fuel atomization and dispersion, sonic wave energy alone appears unable to provide substantially homogeneous intermixing and fuel vaporization under most engine operating conditions.

For these and other reasons, to achieve optimum fuel economy and to substantially reduce air pollution by substantially homogeneous fuel-air intermixing and fuel vaporization into the air flow at substantially all engine operating conditions, improvements to engine carburetor systems, beyond those currently used and previously disclosed, are still necessary.

SUMMARY OF THE INVENTION

An apparatus for homogeneously intermixing flows of fuel and air for an engine or the like comprises a chamber adapted for receiving mainstream flows of fuel and air and for discharging a homogeneous mixture of the fuel and air, and at least one nozzle-matrix formed of a number of nozzle cells arranged in general parallel flow as opposed to series flow relationship. The nozzle-matrix is disposed across at least portions of the chamber, being adapted for receiving at least a portion of at least one of the mainstream flows of fuel and air introduced into the chamber and for dividing the received flow portions into nozzle cell subflows, the nozzle cells being arranged, oriented and structured so that at least some of the subflows are focused towards common cross flow mixing zones where the fuel and air are homogeneously intermixed.

Means are included for selectively restricting the flow through at least some of the nozzle cells, the effective cross sectional area of the nozzle-matrix being thereby varied to maintain pre-selected flow velocity through unrestricted nozzles for different flow rate requirements of fuel-air mixture.

As a specific example, the nozzle-matrix is formed in at least a two-dimensional arcuate shape, the nozzle cells being oriented such that they focus subflows toward pre-selected common cross-flow mixing zones. The restricting means includes an element shaped to conform to one of the surfaces of the nozzle-matrix and which is slid along the surface to selectively cover or uncover various individual nozzle cells. The restricting element may be connected for cooperation with a fuel flow rate controlling element, for automatic fuel metering.

The chamber includes a venturi portion across which the nozzle-matrix is disposed, at least portions of the fuel mainstream flow may be introduced into the chamber in the cross-flow mixing zones where subflows from the nozzle cells converge. The nozzle-matrix may be shaped from a flat structure having dividing partitioning elements formed of corrugated flexible material so that upper portions of these elements can stretch, as the matrix is shaped into an arcuate form, and lower portions can compress into deeper corrugations.

Means may be provided for selectively changing the arrangement, orientation, and structure of the nozzle cells in the matrix to vary the cross-flow intermixing characteristics thereof, in addition to varying the effective combined cross sectional area of the nozzle-matrix. This means includes a tranversely movable element which engages side edge portions of the nozzle-matrix.

An ultrasonic wave generator may be connected to the nozzle-matrix to provide ultrasonic wave energy for enhancing dispersion of the fuel. Heat may be applied to the matrix to enhance vaporization of the fuel.

Various nozzle-matrix configurations and network arrangements of nozzle-matrices, as well as a matrix bypass, may be utilized to advantage according to circumstances and desired fuel and air mixing characteristics and flow rate demands.

Corresponding methods for fuel and air flow intermixing are provided.

By means of the intermixing apparatus and its variations, flows of fuel and air can be intermixed to various degrees, as desired. Intermixing is principally provided by the plurality of individual matrix nozzle cells which focus subflows towards common cross-flow mixing zones for agitation and turbulence. By varying the number of nozzle cells through which flow is permitted, a variable cross sectional venturi is, in effect, created and substantially sonic flow, (or any other desired velocity flow) such as is desirable for optimum fuel atomization, may be maintained over wide ranges of engine fuel and air flow rate demands.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENT

Figure 1:
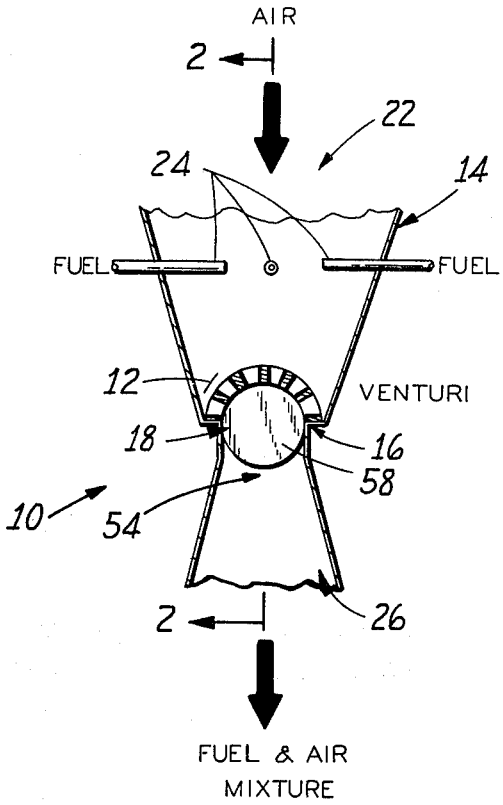
FIG. 1 is a vertical sectional view, showing a nozzle-matrix installed above a venturi portion of a carburetor chamber.
Figure 2:
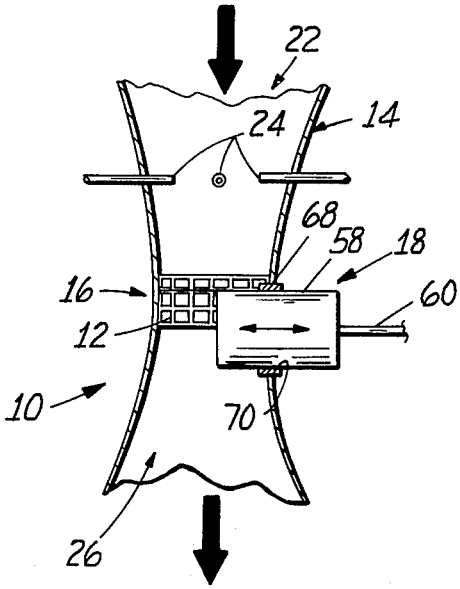
FIG. 2 is a vertical sectional view along line 2—2 of FIG. 1, showing gating means for restricting flow through the nozzle-matrix.

Generally, mixing is accomplished by division, dispersion, and/or vaporization enhanced by pulsation, heating, ultrasonics, and/or sonic boom generation.

Properly mixing fuel and air in a carburetor is an extremely complex problem, for fuel does not mix readily with air even when fuel is vaporized. Air and fuel generally enter the carburetor chamber as relatively largely incoherent mainstream flows. Most conventional carburetors employ mixing techniques which attempt to intersperse said incoherent mainstream flows en bulk with one venturi being substantially formed by the carburetor chamber surrounding sidewalls. Sonic velocity at the venturi is employed therein to disperse and atomize fuel droplets into the air mainstream flows. The relatively small surface area of the conventional carburetor chamber does not promote substantial homogeneous vaporization of the fuel into the air even with the application of external supplementary heat.

In the preferred embodiment, the relatively large incoherent air and fuel mainstream flows are divided into manageable and workable fuel-air subflows in a multitude of substantially laterally positioned open-ended cells. The large, unwieldy mainstream flows are thus divided in volume to facilitate their orientation, velocity maintenance, and subsequent subflow discharge to cause air-fuel intermixing within the carburetor chamber.

Within said cells, said subflows are made coherent to pre-selected characteristics, and thereafter focused toward cross flow mixing zones where said subflows impinge promoting substantial homogenization of fuel and air. Homogenizing the fuel-air mixture entails reducing the fuel droplet size to a minimum, vaporizing fuel, and dispersing fuel vapor and droplets uniformly throughout the air. The result of this homogenizing process is to produce a colloidal suspension of fuel in air, the fuel being uniformly dispersed into the air. The greater the homogeneity, the greater the colloidal stability against coalescense, degradation due to high speed impaction of fuel droplets on chamber and manifold surfaces, and even agglomeration of fuel droplets due to loss of flow velocity because of required venturi enlargement during such extreme conditions as rapid engine acceleration, accleration under loads, and ambient variations. Homogenization by the nozzle-matrix is not limited by sonic flow maintenance, and is insensitive to surges generated by momentary driving conditional variations.

The cells are laterally, adjacently positioned transversely across at least a portion of the carburetor chamber, and the cells inherently because of their relatively large combined surface area, enhance vaporization and the subsequent uniform dispersion of the fuel into the air.

The cells are individually shaped in the form of a nozzle, and the nozzles are disposed to form a nozzle-matrix. Arrangement, orientation, and structure define the nozzle-matrix configuration. As an example, the nozzle cells may be arranged concentrically, oriented convergingly inwardly in a downstream direction, and structured to provide nozzle cells of a generally hexagonal cross section tapering toward a venturi exit.

The nozzle-matrix exterior surface form is defined to either permit mainstream sideflows to bypass the nozzle-matrix or in the alternative, to prohibit mainstream sideflow bypass by the intergral attachment of the nozzle-matrix to the surrounding sidewall of the carburetor chamber.

Subflows through the nozzle-matrix are selectively gated by the employment of two basic methods, as exampled by: (1) rigid nozzle-matrix selectively restricted by a sliding gate, and (2) flexible nozzle-matrix selectively restricted by flexing the nozzle-matrix to expand or contract the nozzle cells.

It is to be noted, that the nozzle-matrix carburetor is so versatile that the nozzle-matrix and carburetor chamber surrounding sidewall both may be constructed of an elastomeric material, the nozzle-matrix being securely afixed to the chamber wall so that the external flexing of the chamber wall forces unison flexing of the nozzle-matrix, thereby selectively varying their respective flow area in mutual cooperation. Rectangular carburetor chambers employing rectangular nozzle-matrices further exemplify the versatility of the variable venturi nozzle-matrix carburetor. And still further, the nozzle-matrix invention can be extended to the chamber surrounding sidewall in that said sidewall could be constructed as a nozzle-matrix having a cooperating gating means in conjunction therewith. No matter how complex the nozzle-matrix configuration may appear, the cost of its fabrication has been minimal.

In order to provide homogeneous intermixing of fuel and air flows to an intake manifold of an internal combustion engine, a carburetor apparatus 10, according to a preferred embodiment, and as illustrated in FIGS. 1 through 5, comprises generally an arcuate nozzle-matrix 12 which is transversely disposed across a fuel and air receiving and mixing chamber or carburetor barrel 14 in the path of fuel and air flows, preferably in a reduced cross sectional area region or venturi portion 16, and a selective nozzle area restricting or gating means 18, portions of which are disposed immediately below the nozzle-matrix.

Figure 3:
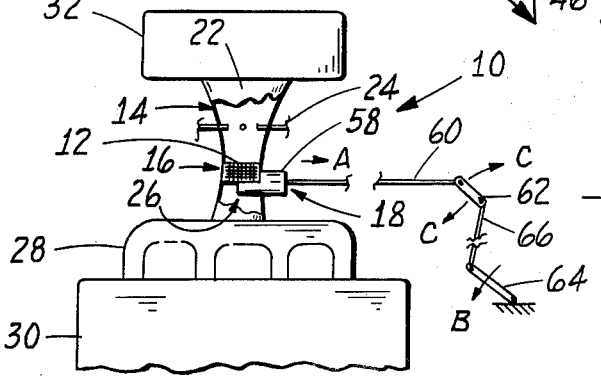
FIG. 3 is a vertical sectional view of the apparatus of FIGS. 1 and 2, shown connected to an intake manifold of an internal combustion engine.

The chamber14, which may, for example, be an existing portion of an internal combustion engine carburetor, or which may be specially formed, generally in barrel form, has an upper air intake opening 22, one or more upper fuel inlets 24, which may be conventional fuel jets connected to one or more float controlled fuel reservoirs, accelerator pumps, etc. (not shown), and a lower outlet opening 26, through which a flow of intermixed fuel and air is discharged into one (or more) intake manifolds 28 connected to an internal combustion engine 30, the manifold and engine being shown in phantom lines in FIG. 3. It is to be understood that the term "air" as used herein and in the appended claims includes any form of oxidizer which may be ordinarily used in combustion of the fuel and, as well, may include various additives commonly used in the combustion process. Also shown in phantom lines in FIG. 3 is an air cleaner 32 mounted above the chamber air intake opening 22 in a conventional manner. Not shown are conventional fuel and air supply and flow control means, it being understood that any such means, well known to those skilled in the art, may be employed in association with the described apparatus 10, which functions to disperse, atomize and vaporize the fuel flow and cause substantially homogeneous dispersion thereof into the air flow, over wide ranges of fuel and air flows, as normally demanded by the engine 30.

Sonic or supersonic (or other selected velocity) fuel and air flow through the venturi portion 16 (the cross section of which is such to provide substantially sonic velocity under varying engine flow rate demands) as well as fuel dispersion, atomization, and vaporization and substantially homogeneous fuel-air intermixing is provided by the nozzle-matrix 12 and the selective nozzle restricting means 18, as more particularly described below.

Figure 4:
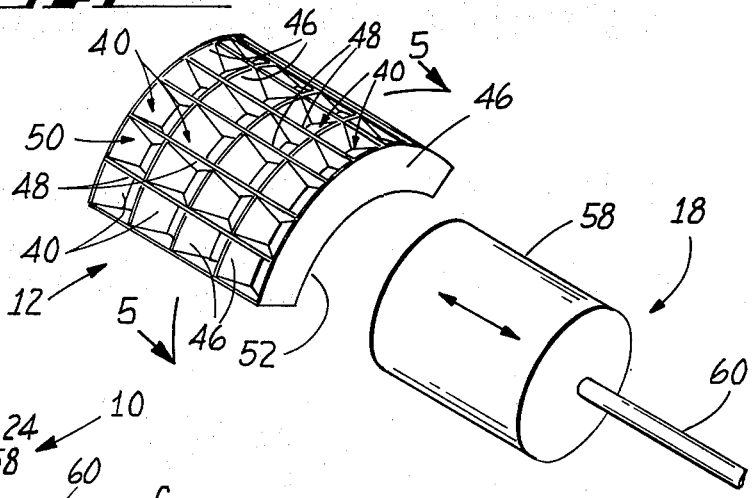
FIG. 4 is an exploded perspective view of the nozzle-matrix and an associated cylindrical matrix flow restrictor.
Figure 5:
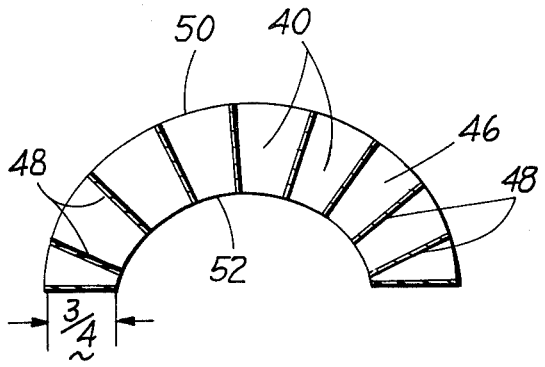
FIG. 5 is a sectional view along line 5—5 of FIG. 4 showing curvature of the nozzle-matrix and a resultant mixing cross-flow focusing zone.

As illustrated in perspective in FIG. 4 and as shown in FIG. 5, the nozzle-matrix 12, which may also be considered an elongated cellular structure, comprises a two-dimensional arcuate structure formed of, or forming, a substantially continuous arrangement of comparatively small cross sectional area, converging individual nozzles or nozzle cells 40. These nozzles 40 are arranged for substantially parallel, as opposed to series, subflows, and may, for example, be about as long as their cross sectional dimensions. That is, the thickness of the entire nozzle-matrix may be about as great as the cross sectional dimensions of individual nozzle cells 40, thus providing a small, compact configuration which could be installed into an intake manifold if so desired. The main upstream flows of fuel and air through the chamber venturi portion 16 being divided or split up by the matrix 12 so that separate sub-flows or portions flow through separate ones of the nozzles 40. It is to be appreciated, however, that the term "substantially parallel flow" is not intended to imply that sub-flows through all the various individual nozzles 40 are in fact actually or even closely parallel, since as shown in FIGS. 4 and 5, the individual nozzles are arranged so that sub-flows emitted therefrom will be focused towards a common center of curvature of the matrix 12, which is downstream of the matrix. Instead, the term "substantially parallel flow" is meant to describe a splitting of a mainstream flow into smaller sub-flows which proceed more or less in the same general direction, and not a series flow that is through first one individual nozzle and then a next nozzle in series, etc. After leaving the individual nozzles 40, the individual nozzle sub-flows are focused and cross-flow mixed, and exit the chamber 14 through the lower chamber opening 26.

The nozzle-matrix 12, as shown, is formed having a plurality of parallel, arcuate thin first dividers or elements 46 which are preferably portions of an arc, each such element having substantially the same curvature. These first elements 46 are orthogonally intersected by second thin dividers or elements 48 which are elongate and rectangular in the nozzle-matrix 12 illustrated, a two-dimensionally curved, generally eggcrate open ended cellular structure being thereby formed. In such structure each individual nozzle 40 is square or rectangular in cross section and has at least some walls in common with adjacent nozzles. Because of the two-dimensional curvature, opposite sides of one pair of sides of each nozzle 40 are parallel. The other pair of sides converges from an upper edge boundary or matrix surface 50 to a lower edge boundary or matrix surface 52. Thus, nozzles 40 of all rows formed in a first transverse direction are parallel and all nozzles in rows orthogonal to this direction converge or are focused towards the common center of curvature of the elements 46. Because of this orientation of rows of individual nozzles 40 towards a common downstream region or mixing zone 54, sub-flows of fuel and air form the nozzles impinge and cross flow to cause further dispersion of the fuel droplets and substantially homogeneous fuel-air intermixing.

Fuel vaporization into the air flow through the individual nozzles 40 is enhanced by selecting widths, thicknesses and spacing of the elements 46 and 48 that provide relatively large surface area to nozzle volume ratios, it being recognized that much fuel vaporization occurs on the nozzle cell surfaces. This mode of fuel-air intermixing by vaporization is particularly important, for example, when streams of fuel are injected into the chamber 14 by accelerator pumps. The nozzle-matrix 12, being in effect a composite nozzle having an extremely large fuel flow contacting surface, is therefore a substantial improvement over comparatively small area, single nozzle or venturi carburetors--even those with variable area venturi capability.

Figure 6:
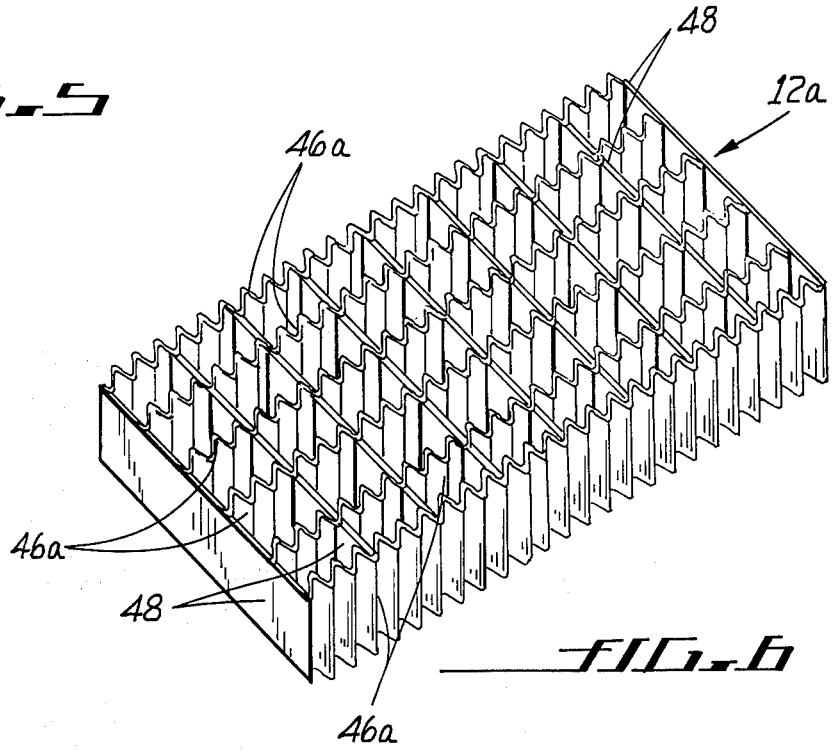
FIG. 6 is a perspective view of a rectangular nozzle-matrix before forming into arcuate form and showing corrugated construction of a set of dividing elements enabling flexing of the matrix.
Figure 7:
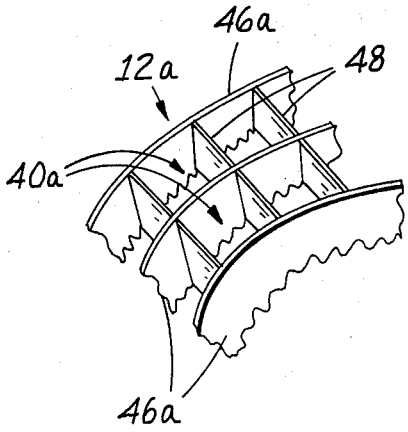
FIG. 7 is a perspective view, showing portions of the nozzle-matrix of FIG. 6 bent into arcuate form.

Although the nozzle-matrix 12 is illustrated as being two-dimensionally curved, it may alternately be three dimensionally curved, forming, for example, a surface portion of a sphere, or it may be formed in other shapes, as further described below. The nozzle-matrix 12 may be of molded or cast form and made from such materials as a fuel resistant plastic or aluminum. Alternatively, as illustrated in FIGS. 6 and 7, a nozzle-matrix **12*a* may be shaped from an initially flat or planar structure in which at least second elements 46*a* are formed of a flexible corrugated material (FIG. 6). This method of construction not only enables easy shaping of the structures into a two-dimensional curve (FIG. 7), in which upper portions of the elements 46*a* are expanded by stretching the corrugations and lower portions are compressed by making the corrugations deeper, but also substantially increases the exposed surface area of the nozzles 40*a* formed to enhance fuel vaporization. If a three-dimensionally curved nozzle-matrix is to be formed in this manner, both the elements 46 and 48 may be constructed of corrugated materials in the manner of constructing the elements 46*a***.

Even though the nozzle-matrix 12 alone provides very substantial improvements over single venturi carburetors in terms of greatly increased fuel vaporization, fuel atomization and fuel droplet dispersion into the flow of air through the individual nozzles 40, to form a homogeneous fuel-air mixture, additional benefits may be provided by the nozzle restricting means 18, which is selectively operable to restrict or close off some fo the individual nozzles 40 for low fuel to air ratio mixture demands by the engine 30 as during deceleration.

As best seen in FIGS. 1 through 4, the restricting means 18 include a non-porous cylindrical gate 58, either solid or tubular, which is slidably installed through a side of the chamber 14 so that an upper surface of the cylindrical gate is immediately below the lower nozzle-matrix surfaces 52. By sliding the cylindrical gate 58 transversely into and out of the chamber 14, by means of an axially connected control rod 60, rows of indivudal nozzles 40, starting with the row of nozzles adjacent to the cylindrical inner sidewall of the chamber, may be fully or partially closed or opened to vary the combined effective cross sectional nozzle cell area of the nozzle-matrix to insure a substanaially sonic flow (or a flow at any other selected velocity) therethrough for fulfilling varying fuel-air flow rate demands by the engine 30.

Transverse advancement and retraction of the gate 58 may be accomplished in any manner, including manual operation of the control rod 60, for example, in response to readings on a vacuum gauge and RPM. Preferably, however, automatic control is provided. As shown in FIG. 3, the control rod 60 is connected to one end of a bell crank 62; a conventional accelerator or gas pedal 64 is connected, by a push rod 66, to the other end of the bell crank, the bell crank being pivotally mounted to a fixed frame member (not shown) intermediate the end connections of the rods 60 and 66. With such type configuration, the gate 58 is caused to be withdrawn from the chamber 14 (direction of Arrow A), thereby uncovering and permitting flow through more of the nozzles 40, when the pedal 64 is depressed (direction of Arrow B) and the bell crank is rotated in a clockwise direction (Arrow C). Thus, as the gas pedal 64 increases fuel and air flow through the chamber 14, the effective cross sectional flow area of the nozzle-matrix 12 is increased. As the pedal 64 is released, the reverse occurs, and the gate 58 is advanced into the chamber 14, closing off some of the nozzles 40 and maintaining sonic (or other) velocity flow through unrestricted nozzle cells.

Even though an asymmetrical flow condition may be locally created by advancing the gate 58 from one side of the chamber 14, impingement of the sub-flows of fuel and air from the angle oriented nozzles 40 causes sufficient turbulence in the chamber below the nozzle-matrix 12 that there is little, if any, downstream effect of any asymmetry at the nozzle-matrix exit. It is, however, within the scope of the invention to employ a second gate 58 (not shown) which may be advanced through an opposite side of the chamber 14 and operable in unison with the first gate so that restriction of the nozzles 40 is symmetrically accomplished with respect to chamber cross section.

Fuel and air leakage from the chamber 14 in the region of the gate 58 is prevented by one or more conventional O-ring seals 68 (FIG. 2) installed in a chamber aperture 70 which receives the gate.

Although the restricting means 18 has been shown and described above as including a gate 58 of cylindrical form disposed immediately below the nozzle-matrix 12, it is to be appreciated that other flow restricting elements may alternately be employed (or that none may be employed). For example, instead of a cylindrical gate 58 or even a semi-cylindrical gate an arcuate sheet (not shown) may be used, and may be disposed either below the nozzle-matrix 12, as has been shown for the cylindrical gate, or immediately above the nozzle-matrix, thereby covering upper boundary ends of selected nozzles. This last mentioned configuration may be employed to advantage if, instead of (or in addition to) fuel being introduced into the chamber 14 above the nozzle-matrix 12, fuel is admitted to the chamber in the venturi portion 16 below the nozzle-matrix, at or above the cross-flow mixing zone of nozzle flow convergence 54, as may sometimes be necessary or desired.

VARIATIONS OF FIGS. 8 - 21

Several illustrative variations of, or additions to, the above described apparatus 10 are depicted in FIGS. 8–21, in which substantially indentical elements and features are given the same reference numbers and similar elements and features are given the same reference number followed by different letters. Although various of these figures depict use of flow restricting means 18 or variations thereof, it is to be understood that such means may be used in all such variations or may be omitted from any or all variations.

Figure 8:
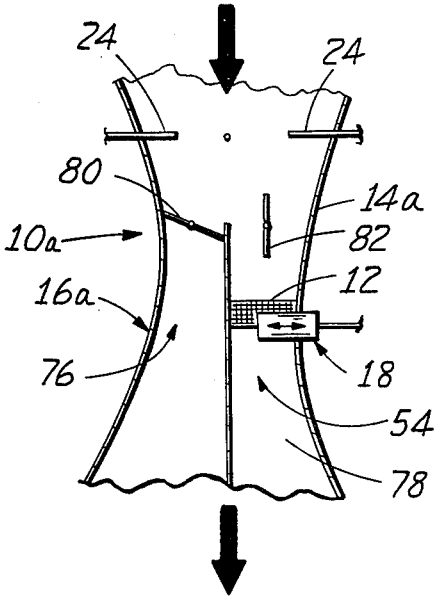
FIG. 8 is a vertical sectional view of a mixing chamber providing flow bypassing of the nozzle-matrix.

FIG. 8, for example, illustrates an apparatus **10*a*, which is similar to the above described apparatus 10 except that a chamber 14*a* has a bypass portion or subchamber 76 formed in parallel with a portion or subchamber 78 in which the nozzle-matrix 12 and the restricting means 18 are disposed. A first butterfly valve 80 is installed at an upper end of the bypass portion 76 and a second butterfly valve 82 is installed in a similar position in the portion 78. By selectively operating the valves 80 and 82, mainstream fuel and air flows can be diverted to either portion 76 or 78 (FIG. 8 illustrates the bypass portion 76 completely closed by the valve 80**), or divided in any desired proportion between the two subchambers.

Figure 9:
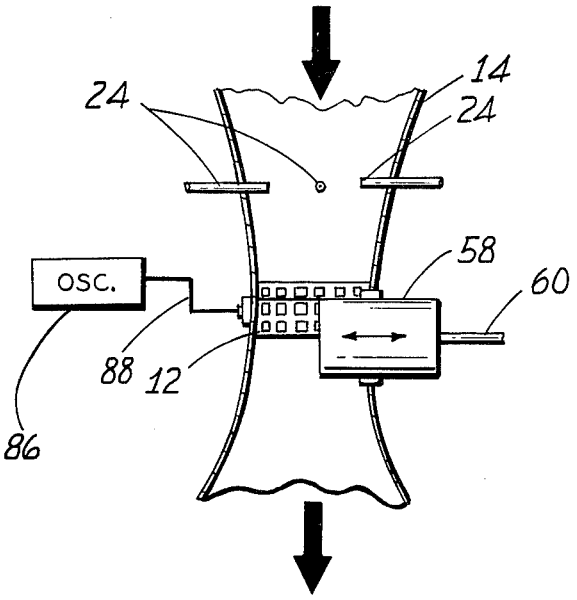
FIG. 9 is a vertical sectional view of the apparatus to which an ultrasonic wave generator is connected to enhance fuel-air dispersion.
Figure 10:
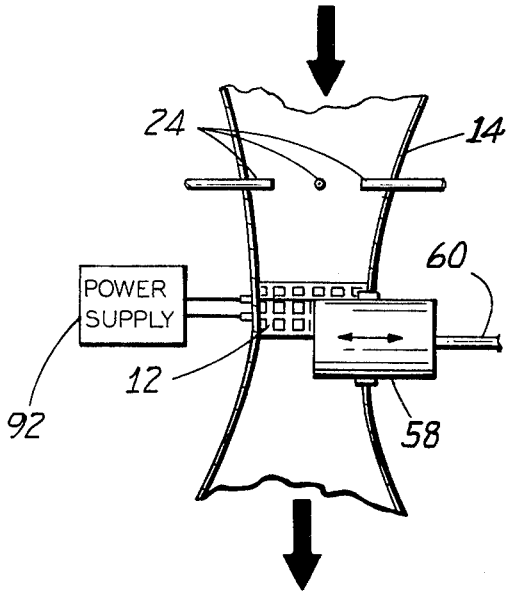
FIG. 10 is a vertical sectional view of the apparatus showing means for heating the nozzle-matrix to enhance fuel vaporization.

FIG. 9 illustrates means for enhancing fuel-air intermixing and fuel vaporization characteristics of the described apparatus 10 by supplying ultrasonic wave energy to the apparatus, the large surface area of the nozzle-matrix producing highly efficient transfer of ultrasonic energy to the subflows. As shown, an ultrasonic frequency generator or source 86 is connected directly, via a line 88, to the nozzle-matrix 12 to cause ultrasonic vibration thereof, the vibrations supplying ultrasonic energy to the fuel and air subflows through the nozzles 40, to further atomize the fuel droplets, vaporize fuel by the heat generated, and enhance fuel and air intermixing. Alternatively, a conventional sound wave transducer (not shown) may be used, preferably being positioned in or near the cross-flow mixing zone so as to provide ultrasonic wave heating and mixing in another advantageous location. Such added ultrasonic energy may be beneficial when, for example, large quantities of fuel must suddenly be supplied to low velocity air flows to a particular type engine, and added intermixing may be necessary for mixture homogeneity and stability.

It may also be advantageous, under some conditions, to provide additional energy to the apparatus 10 directly in the form of heat from a power source 92, which is shown (FIG. 10) connected to the nozzle-matrix 12. Included in the nozzle-matrix 12, or attached thereto, is a conventional resistive heating element (not shown). By heating the nozzle-matrix 12, vaporization of fuel into the air flow in enhanced. Other portions of the apparatus may additionally or alternatively be heated.

Figure 11:
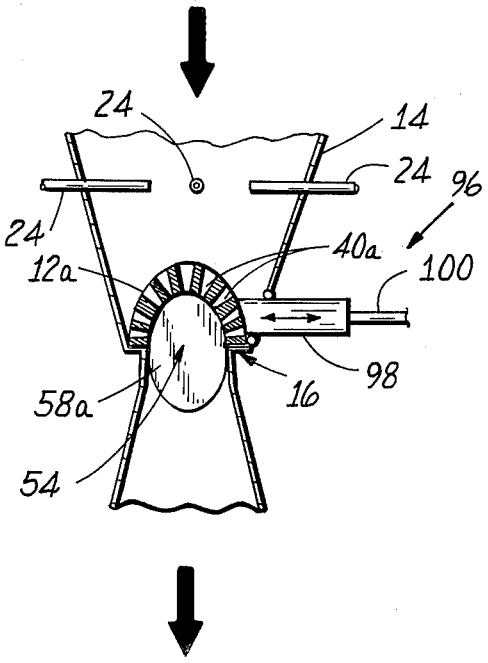
FIG. 11 is a vertical sectional view of the apparatus, showing means for selectively varying the cross sectional areas of the nozzles in the matrix and for changing flow focusing and cross flow intermixing characteristics.

FIG. 11 illustrates the addition of a nozzle-matrix curvature changing means 96, which is somewhat similar to the restricting means 18 above described. A flexible, arcuate nozzle-matrix similar, for example, to the above described nozzle-matrix 12*a* is employed, as is a flexible flow restricting gate 58*a.* A cylinder or other element 98, operated by a push rod 100 in any conventional manner, is installed through a side wall of the chamber 14 orthogonally to the axis of the gate 58*a,* to bear directly against a lower side boundary edge of the nozzle-matrix 12*a.* Moving of the cylinder 98 inwardly or outwardly causes the configuration of the nozzle-matrix 12*a* to be changed, thereby changing the effective combined cross sectional area of at least some of the nozzles 40*a* and changing the nozzle impingement or cross-flow zone positioning. Such configuration changing means may, for example, be advantageous for "fine" selective turning of the apparatus.

Figure 12:
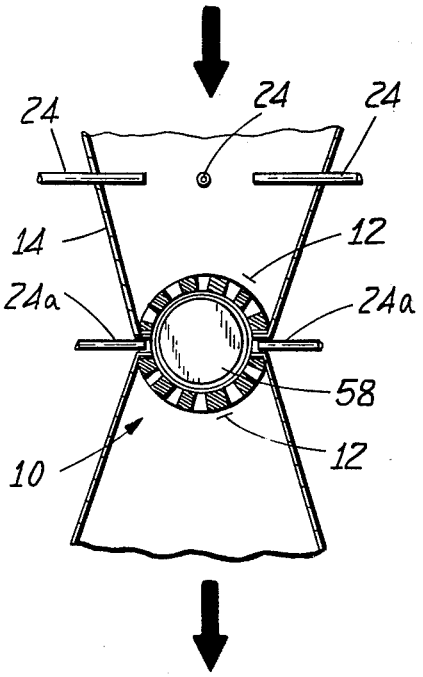
FIG. 12 is a vertical sectional view, showing two nozzle-matrices arranged in series.

A network comprising two series arranged nozzle-matrices 12 is illustrated in FIG. 12. To further enhance fuel-air intermixing in the chamber 14, the intermixed fuel and air subflows from the uppermost nozzle-matrix 12 are received, for further fuel dispersion and vaporization by the lower nozzle-matrix. As illustrated, the upper nozzle-matrix 12 is installed in the chamber in the concave downward orientation of FIG. 1; the lower matrix 12 is, however, installed in a concave upward orientation, a generally cylindrical composite nozzle-matrix being formed. The two nozzle-matrices 12 share a common cylindrical gate 58 which is operable to restrict sub-flows through both nozzle-matrices in the manner described above.

Also as illustrated in FIG. 12 added fuel flows may be admitted into the chamber 14 along regions between the two nozzle-matrices 12, through fuel inlets 24*a.* A plurality of these fuel inlets 24*a* may be arranged so that operation of the gate 58 also serves to restrict fuel flow into the chamber 14 through one or more of these fuel inlets.

Figure 13:
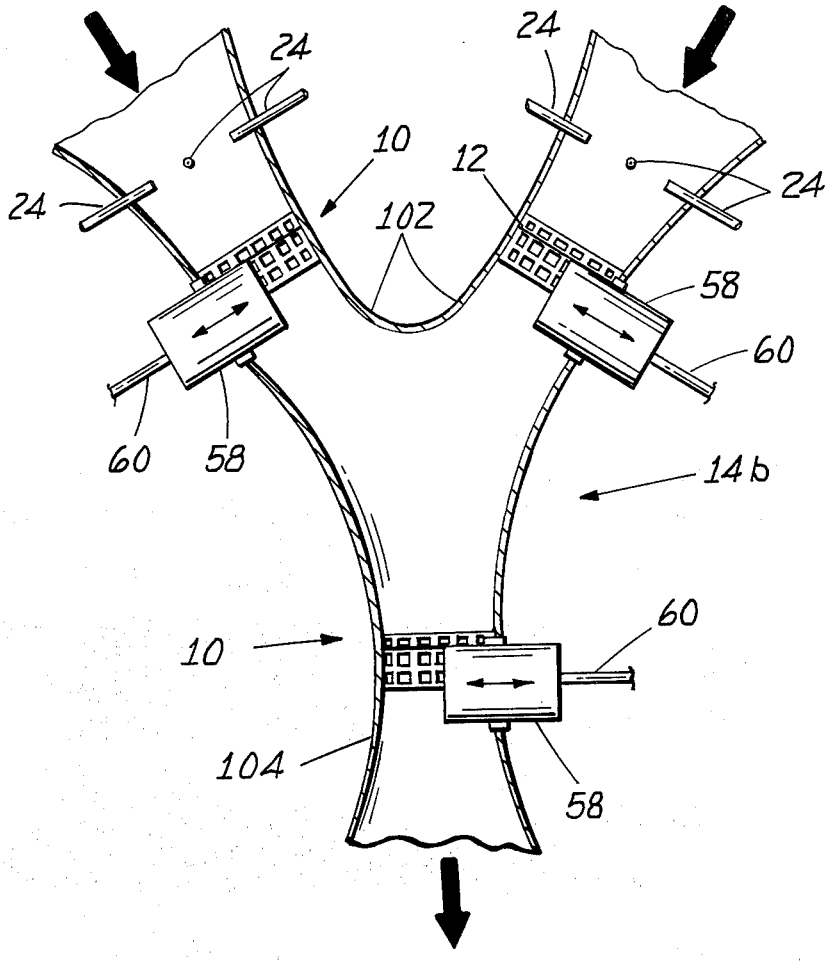
FIG. 13 is a vertical sectional view showing a series/-parallel arrangement of three nozzle-matrices in a Y-shaped network mixing chamber.

FIG. 13 illustrates a Y-shaped chamber 14*b* having installed in each arm thereof an apparatus 10, mainstream fuel and/or air flows being received into upper portion of upper arms 102 and a homogeneously mixed flow of fuel and air being discharged from a lower arm 104. Such parallel series networks may be useful, for example, when two different types of fuels are used, each flow of fuel being intermixed with air in its associated upper arm 102, and a substantially homogeneous fuel-air mixture (mixed by the lower arm apparatus 10) being discharged from the lower arm 104. In such an arrangement, either fuel may also be used along by supplying a fuel flow to just one of the arms 102. This general network may also be advantageously used for receiving only a mainstream fuel flow into one upper arm 102 and for receiving only a mainstream air flow into the other upper arm.

Figure 14:
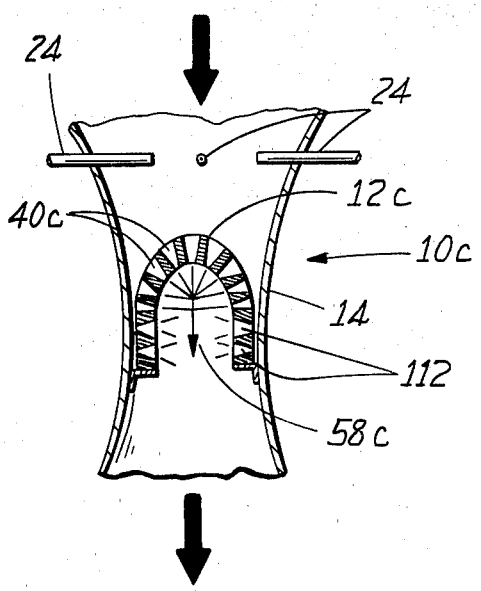
FIG. 14 is a vertical sectional view of an inverted, generally V-shaped nozzle-matrix having a vertical planar crossflow mixing convergence zone.

Illustrated in FIG. 14 is an apparatus 10*c* which includes a nozzle-matrix 12*c* formed in the general shape of an inverted U or V, and having opposing elongate lower matrix portions or legs 112 which are diverging. Because of the manner in which the nozzle-matrix 12*c* is configured, sub-flows from the various nozzle cells 40*c* comprising the matrix converge generally towards a vertical planar cross flow zone 54*c,* rather than towards a generally point cross flow zone. A gate 58*c,* having a contour matching that of the lower surface of the nozzle-matrix 12*c,* is provided for selectively restricting sub-flows through various of the nozzle cells 40*c.* The nozzle-matrix 12*c* may be two dimensionally curved, as shown, or may be three dimensionally curved in a generally paraboloid shape.

Figure 15:
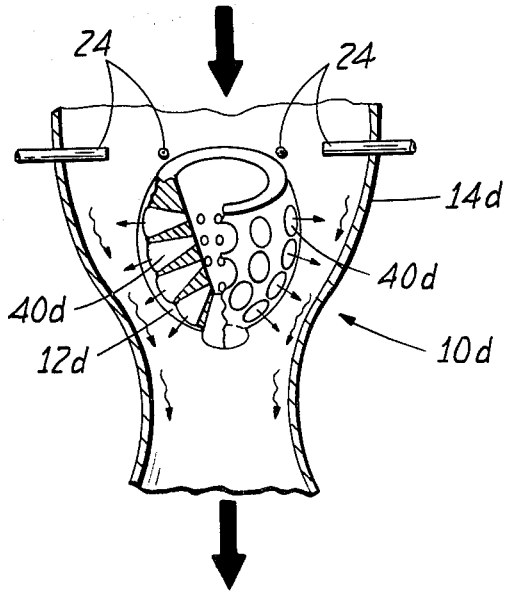
FIG. 15 is a vertical sectional view of a generally conically shaped, vertically movable nozzle-matrix.

In FIG. 15, an apparatus 10*d* having an inverted, generally conical three dimensionally curved nozzle-matrix 12*d* is shown. The nozzle-matrix 12*d* is somewhat similar to the above described nozzle-matrix 12*c* except that the direction of the sub-flows through the nozzle cells 40*d* is generally reversed, the matrix 12*d* being concave upwardly and the general mainstream flow direction being into the large upper opening of the matrix and outwardly through the various nozzle cells. Cross flow mixing of fuel and air is provided in the apparatus 10*d* by spacing sides of the nozzle-matrix 12*d* outwardly from converging sides of the chamber 14*d* a sufficient distance so that sideflow portions of the main upstream flows of air and fuel, which enter the top of the chamber, bypass the nozzle-matrix 12*d* and flow between the respectively opposing outer surfaces thereof and adjacent inner surfaces of the chamber 14*d.* Subflows from the nozzle cells 40*d* thus intersect these sideflows for substantially homogeneous fuel and air intermixing. To further enhance intermixing of fuel and air for all engine demand conditions, the nozzle-matrix 12*d* is preferably axially movable relative to the chamber 14*d* so that the annular side flow cross sectional area can be varied to permit more or less nozzle-matrix flow bypassing, as may be desired.

Figure 16:
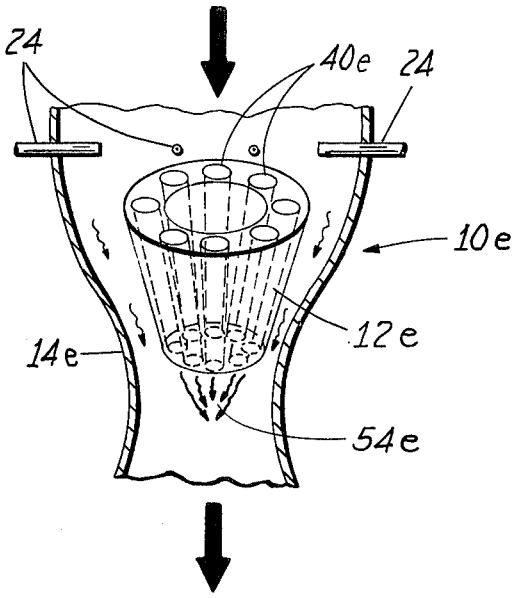
FIG. 16 is a partial perspective and partial vertical sectional view of a second type of a generally conically shaped nozzle-matrix.

A generally conical nozzle-matrix 12*e* of an apparatus 10*e* is shown in FIG. 16. Instead of having generally transverse or radial nozzle cells, the nozzle-matrix 12*e* is formed of a number of elongate, converging nozzle cells 40*e* which extend the entire length of the matrix 12*e.* Subflows from these various nozzle cells 40*e* converge towards a common cross flow mixing zone 54*e.* As with the previous apparatus 10*d* of FIG. 15, portions of the main upstream flows of fuel and air bypass to nozzle-matrix 12*e* and flow between outside surfaces of the matrix and inside surfaces of the chamber 14. The matrix 12*e* may be axially movable to vary the annular side flow cross sectional area.

Figure 17:
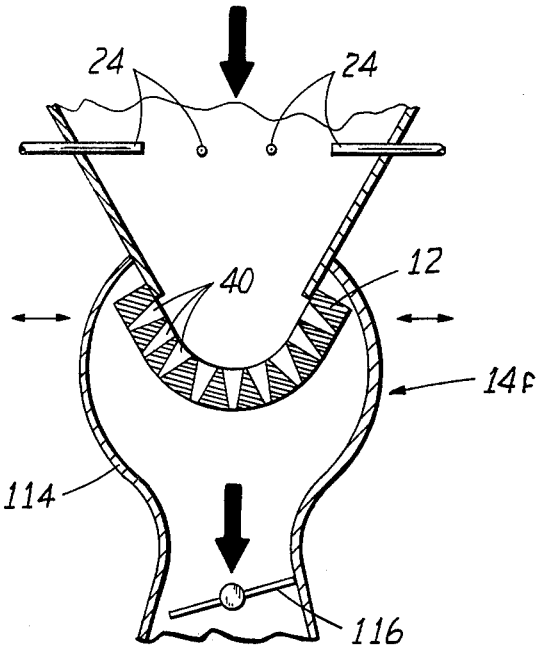
FIG. 17 is a vertical sectional view of an upwardly concave, flexible nozzle-matrix mounted in a flexible portion of a flow mixing chamber.

In FIG. 17, an inverted flexible nozzle-matrix 12 is installed on upper region of a flexible bulbous portion 114 of a chamber 14*f.* Sides of the flexible portion 114 may be inwardly or outwardly flexed, preferably automatically in response to engine fuel-air demand, to thereby vary the curvatures of the nozzle-matrix 12 and hence its flow characteristics. Cross flow mixing of subflows from the nozzle cells 40 is provided by subflows of upper nozzle cells being directed towards adjacent concave inner walls of the chamber portion 114 and being directed back into subflows from adjacent nozzle cells. A butterfly valve 116 may be provided in a converging region of the chamber 14*f,* below the nozzle-matrix 12*f* to regulate flow through the entire apparatus.

Figure 18:
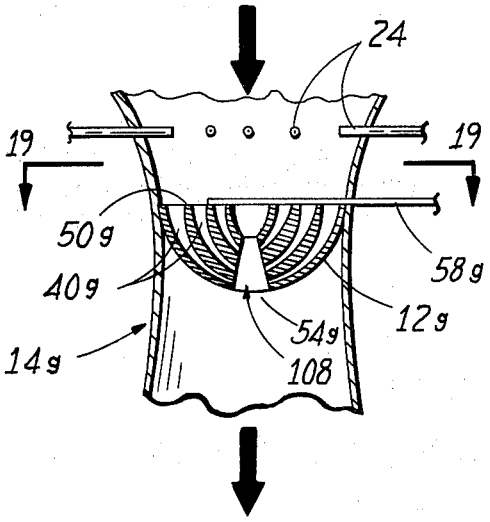
FIG. 18 is a vertical sectional view showing a nozzle-matrix formed of a number of curved nozzle cells.
Figure 19:
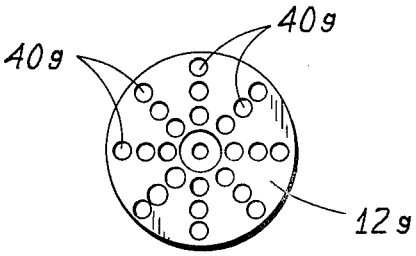
FIG. 19 is a horizontal view along line 19—19 of FIG. 18 showing other features of the FIG. 18 nozzle-matrix.

FIGS. 18 and 19 illustrate a generally hemishperically shaped nozzle-matrix 12*g* having a generally conically shaped subflow outlet region 108 on an under side. The three dimensionally curved matrix 12*g* comprises a number of nozzle cells 40*g* having inlet openings on a common upper surface plane and which are formed in arcuate shape so that subflows therefrom converge along a common linear cross flow zone 54*g* along the axis of the chamber 14*g* and generally within the confines of the matrix. Because one surface-on upper surface or boundary edge 50g-of the nozzle-matrix 12g is planar, a planar gate 58g may be employed to regulate flow through its matrix. This results in somewhat easier flow control of the matrix 12g, and also pre-selected flow velocity maintenance.

Figure 20:
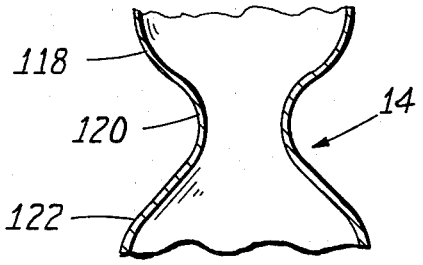
FIG. 20 is a vertical sectional view showing a converging-diverging mixing chamber or nozzle cell.
Figure 21:
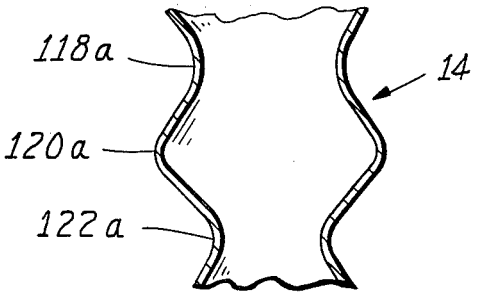
FIG. 21 is a vertical sectional view, showing a converging-diverging series mixing chamber or nozzle cell.

Two different general shapes for either or both the nozzle cells 40 and the chamber 14 are illustrated in FIGS. 20 and 21. FIG. 20 illustrates an upper converging portion 118, a central constant portion 120 and a lower diverging portion 122. FIG. 21, on the other hand, illustrates an upper converging portion 118a, a central diverging-converging portion 120a and a lower diverging portion 122a. Although the apparatus 10 and its several variations have been illustrated and described as homogeneously intermixing flows of fluid fuel and air, it is to be understood that the apparatus may be employed with other types of fuels and (as previously mentioned) oxidizers, it being unnecessary that the fuel in fact be volatile or that the oxidizer be pressurized air. For example, the oxidizer may itself be a mixture of air and other gases or desired additives. The apparatus is also equally adaptable for intermixing solid and/or fluid components, and is of course adaptable for mixing more than two components, as may often be desired. For instance, a second fluid, such as alcohol (to prevent carburetor icing), may be injected into the chamber 14 above the matrix 12 or in the nozzle cross flow mixing zone 54 and be intermixed with the fuel and air by the apparatus.

Corresponding methods for homogeneously intermixing fuel and air flows and for enhancing fuel vaporization are provided, and although there have been described above specific arrangements of a fuel-air mixing or carburation apparatus and variations thereat in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. Apparatus for substantially homogeneously intermixing flows of fuel and air to be supplied to an engine or the like, which comprises:

a. a chamber adapted for receiving mainstream flows of fuel and air and for discharging a substantially homogeneous mixture of said flows, b. a matrix including a number of nozzle cells arranged in generally parallel flow, as opposed to series flow, relationship, said nozzle-matrix being disposed within the chamber in a position adapted for receiving at least a portion of the mainstream flows of fuel and air and for causing said received flow portion to be divided into separate subflows through said nozzle cells, said nozzle cells being arranged, oriented, and structured to focus said subflows therefrom towards a common downstream cross flow mixing zone defined by the nozzle-matrix center of curvature and adapted for substantially homogeneously intermixing fuel and air from said mainstream flows, at least most of said nozzle cells having cross sections which converge towards said common mixing zone and having nozzle cell lengths at least comparable to cross sectional dimensions thereof.

2. The apparatus according to claim 1, including gating means for selectively restricting flow through at least some of said nozzle cells to thereby vary the effective cross sectional flow area of said nozzle-matrix and enable a preselected flow velocity to be maintained therethrough over varying engine demands for fuel and air from the chamber.

3. The apparatus according to claim 2, wherein said gating means includes a movable gating element and including means responsive to demand for fuel and air from the engine for moving said gating element into and out of engagement with at least some of said nozzle cells.

4. The apparatus according to claim 1, wherein the chamber includes a converging venturi portion and wherein said nozzle-matrix is positioned generally in said venturi portion.

5. The apparatus according to claim 1, wherein said chamber is divided into at least first and second generally parallel flow subchambers, said nozzle-matrix being disposed in said first subchamber, and including means adapted for selectively dividing the mainstream flows of fuel and air which are received into the chamber upstream of said subchambers between said first and second subchambers.

6. The apparatus according to claim 5, wherein said means for dividing flow between said first and second subchambers includes first and second selectively operable valves disposed respectively in said first and second subchambers.

7. The apparatus according to claim 1, including a second nozzle-matrix similar to said first mentioned matrix, said second nozzle matrix being disposed in said chamber to be concave upwardly and downstream of said first mentioned nozzle-matrix so as to receive a cross flow first mixture of fuel and air, and to discharge a second mixture of more finely divided fuel and air.

8. The apparatus according to claim 1, wherein said chamber is adapted for receiving at least a portion of said mainstream fuel flow into said cross flow mixing zone.

9. The apparatus according to claim 1, including means for providing ultrasonic wave energy to the general region of said cross flow mixing zone to thereby enhance fuel atomization, vaporization and dispersion.

10. The apparatus according to claim 9, wherein said ultrasonic wave energy providing means includes an ultrasonic wave generator having an output thereof connected to said nozzle-matrix.

11. The apparatus according to claim 1, including means for heating portions of said nozzle-matrix to cause enhanced fuel vaporization and homogeneous fuel dispersion.

12. The apparatus according to claim 1, wherein the combined surface area of the nozzle cells forming the nozzle-matrix is very substantially greater than the surface area of the chamber region in which the nozzle-matrix is disposed.

13. The apparatus according to claim 1, wherein said nozzle-matrix is formed in an open, egg-crate configuration having elongate first parallel wall elements in a first direction and elongate second parallel wall elements in a second direction which is generally orthogonal to said first direction, said first and second elements intersecting to form the nozzle cells, said nozzle cells thereby being formed having generally rectangular cross sections.

14. The apparatus according to claim 1, wherein at least one of the structures defining nozzle cell walls and chamber walls is formed having an upper converging region, an intermediate cylindrical region and a lower diverging region.

15. The apparatus according to claim 1, wherein at least on of the structures defining nozzle cell walls and chamber walls is formed having an upper converging region, an intermediate diverging-converging region and a lower diverging region.

16. An apparatus for substantially homogeneously intermixing flows of fuel and air to be supplied to an engine or the like, which comprises:

a. a chamber having an upper portion adapted for receiving mainstream flows of fuel and air, an intermediate converging venturi portion and a lower portion adapted for discharging a substantially homogeneously intermixed flow of fuel and air into an engine intake system, and b. a nozzle-matrix disposed transversely across the chamber in said intermediate region, said nozzle-matrix including a number of closely spaced nozzle cells which are arranged for dividing said mainstream flows of fuel and air directed thereto into a number of nozzle cell subflows and for focusing the subflows from the nozzle cells to a common cross flow mixing zone defined by the nozzle-matrix center of curvature and downstream of the nozzle-matrix to cause substantially homogeneous intermixing of the fuel and air; at least most of the nozzle cells having cross sections which converge towards said common mixing zone and having nozzle cell lengths at least comparable to cross sectional dimensions thereof.

17. The apparatus according to claim 16, including gating means for selectively restricting flow through at least some of the nozzle cells in response to fuel and air mixture demands from an engine with which the apparatus is associated, thereby enabling flow velocity through unrestricted portions of the nozzle-matrix to be maintained substantially at a preselected level regardless of the varying mixture flow rate requirements of the engine.

18. A method for substantially homogeneously intermixing flows of fuel and air or the like in a flow-through mixing chamber, which comprises the steps of:

a. forming a matrix having a number of closely spaced nozzle cells into at least a two dimensional arcuate shape having the nozzle cells oriented, structured, and arranged to focus flows therefrom towards a common, cross flow mixing zone (;) defined by the nozzle-matrix center of curvature, and having the nozzle cells converging towards said mixing zone and furthermore forming the nozzle cells to have lengths at least comparable with cross sectional dimensions;

b. installing the matrix across at least a portion of the mixing chamber with the common cross flow mixing zone generally downstream of the nozzle cells;

c. flowing at least portions of mainstream flows of fuel and air received into the chamber through the nozzle-matrix so that said portions are divided into subflows through said nozzle cells for substantially homogeneously intermixing the fuel and air at said cross flow mixing zone, and d. discharging said substantially homogeneously intermixed fuel and air from the chamber.

19. The method according to claim 18, including the step of maintaining flow velocity through the nozzle-matrix at a predetermined level, relatively independently of the flow rate of said mainstream flows of air and fuel, by restricting flow through selected ones of the nozzle cells to vary the effective combined cross sectional area of the nozzle-matrix.

20. The method according to claim 18, including the step of enhancing fuel dispersion and fuel-air intermixing by the application of ultrasonic energy to nozzle cell subflows.

21. The method according to claim 18, including the step of enhancing fuel vaporization by supplying heat energy to nozzle cell subflows.

22. The method according to claim 18, including the step of enhancing homogeneous fuel and air intermixing by installing across the mixing chamber a second nozzle-matrix similar to the first mentioned nozzle-matrix downstream of the first mentioned nozzle-matrix and in flow series relationship therewith.

23. The method according to claim 18, wherein the cross flow mixing zones are uniformly distributed throughout the flow passage for substantially homogeneous fuel-air intermixing by preselected arrangement of the nozzle cells in the nozzle-matrix.

24. Apparatus for substantially homogeneously intermixing flows of fuel and air to be supplied to an engine or the like, which comprises:

a. a chamber adapted for receiving mainstream flows of fuel and air and for discharging a substantially homogeneous mixture of said flows, said chamber being formed in a general Y-shape or having first and second upper arms and a lower arm.

b. first, second and third nozzle matrices each including a number of nozzle arranged in generally parallel flow, as opposed to series flow, relationship, said first nozzle matrix being disposed across the lower arm of the chamber and the second and third nozzle matrices being disposed, respectively, across the first and second chamber upper arms, the second and third nozzle matrices being disposed for receiving at least a portion of at least one of the mainstream flows of fuel and air and for causing said received flow portion to be divided into separate subflows through the nozzle cells, at least some of the nozzle cells being arranged, oriented and structured to direct the subflows towards at least one cross flow mixing zone adapted for substantially homogeneously intermixing fuel and air from the mainstream flows, the first nozzle-matrix being positioned to receive merging flows from the third and second nozzle-matrices and for causing flows therefrom to be divided into separate subflows through the nozzel cells thereof, at least some of the nozzle cells of the first nozzle-matrix being arranged, oriented and structured to focus subflows therefrom towards at least one cross flow mixing zone associated therewith, for further intermixing fuel and air flow mixtures from the second and third nozzle matrices.

25. Apparatus for substantially homogenously intermixing flows of fuel and air to be supplied to an engine or the like, which comprises:

a. a chamber adapted for receiving mainstream flows of fuel and air and for discharging a substantially homogeneous mixture of said flows, b. at least one nozzle-matrix including a number of nozzle cells arranged in generally parallel flow, as opposed to series flow, relationship, the nozzle-matrix being formed in an open, egg crate like configuration having elongate first, generally parallel wall elements in a first direction and elongate second generally parallel wall elements in a second direction which is generally orthogonal to the first direction, the first and second elements intersecting to form the nozzle cells, the nozzle cells thereby being formed having generally rectangular cross sections, at least the first wall elements being constructed of a flexible corrugated material, thereby permitting the nozzle-matrix to be formed into at least a two-dimensional curved structure, upper portions of said first wall elements being capable of being stretched and lower portions of said first elements being capable of compressed so as to permit said flexing, said nozzle-matrix being disposed within the chamber in a position adapted for receiving at least a portion of the mainstream flows of fuel and air and for causing said received flow portion to be divided into separate subflows through the nozzel cells, at least some of said nozzle cells being arranged, oriented and structured to focus said towards at least one cross flow mixing zone adapted for substantially homogeneously intermixing fuel and air from said mainstream flows.

* * * * *